US005484164A

United States Patent [19]

McInerney et al.

[11] Patent Number: 5,484,164

[45] Date of Patent: Jan. 16, 1996

[54] ROLLER SKATE LIGHTING SYSTEM

[76] Inventors: James M. McInerney; Mitch E. Norman, both of P.O. Box 1131, Carnelian Bay, Calif. 96140

[21] Appl. No.: 217,413

[22] Filed: Mar. 24, 1994

[51] Int. Cl.[6] ..... A63C 17/26

[52] U.S. Cl. ..... 280/112; 280/1122; 362/61; 362/78; 362/103

[58] Field of Search ..... 280/11.19, 809, 280/11.2, 11.22, 11.23, 87.042; 362/61, 83.3, 78, 103, 253

[56] References Cited

U.S. PATENT DOCUMENTS

| | | | |
|---|---|---|---|
| 2,505,154 | 4/1950 | Smith | 280/11.22 |
| 3,008,038 | 11/1961 | Dickens et al. | 362/103 |
| 4,367,515 | 1/1983 | Beard | 362/103 |
| 4,848,009 | 7/1989 | Rodgers | 352/103 |
| 4,997,196 | 3/1991 | Wood | 280/87.042 |
| 5,033,212 | 7/1991 | Evanyk | 362/103 |
| 5,257,795 | 11/1993 | Babcock | 280/11.22 |
| 5,292,141 | 3/1994 | Ekedal et al. | 280/87.042 |
| 5,357,697 | 10/1994 | Lin | 362/103 |
| 5,381,615 | 1/1995 | MacMillan | 362/103 |

*Primary Examiner*—Richard M. Camby
*Attorney, Agent, or Firm*—Chase & Yakimo

[57] ABSTRACT

An illumination system for a roller blade, roller skate, or the like comprises a power source in the form of a battery pack mounted along the back of the roller blade boot. A plurality of lights are mounted along the sides of the boot and between a front headlight and rear brake light. The brake light is operated by the brake pad of the roller blade. Upon system activation the respective side, head and brake lights indicate the presence of the roller blader, illuminate the user's path and indicate a braking action of the roller blader. The circuit wires may be embedded in the boot during the manufacturing process with the lights fitted thereon by any conventional manner.

10 Claims, 4 Drawing Sheets

ROLLER SKATE LIGHTING SYSTEM

BACKGROUND OF THE INVENTION

This invention relates to safety devices for roller skates and, more particularly, to a lighting system indicating the presence of a roller blader and the skating action thereof.

The use of in-line roller skates, commonly referred to as roller blades, is a popular one. This popularity has increased the appearance of roller bladers in the early evening and nighttime hours. Accordingly, it is desirable to provide means to indicate the presence of such roller skaters. It is also desirable to provide an illumination system for lighting a skating path of the roller blader as well as to indicate to companion skaters the skater's braking action.

Although reflector strips are available to indicate to third parties the presence of a skater, such strips are not effective in the dusk hours, particularly if passing motorists do not have their car lights on. Moreover, such reflector strips do not provide any illumination for the skater's path or indicia to companion skaters that the skater is performing a braking action.

Even though flashlights are available to illuminate the skating path, the use of such lights is a cumbersome one. Also, a skater who initiates his/her skating in the daylight hours is unlikely to carry a flashlight if the skating is not intended to extend into the dusk and/or nighttime hours. Moreover, such flashlights will not effectively indicate the skater's presence to third parties and/or the skater's braking action to fellow skaters.

In response thereto I have invented a lighting system for use with roller blades, roller skates, or the like that provides lights to indicate to third parties the presence of a roller skater as well as a headlight which illuminates the skating path. Additionally, my lighting system indicates the braking action of the skater to companion skaters.

It is therefore a general object of this invention to provide a lighting system for use on roller blades or the like.

Another object of this invention is to provide a lighting system, as aforesaid, which is easily associated for functional use with roller blades or the like.

Another object of this invention is to provide a lighting system, as aforesaid, which illuminates the skating path of the roller blader.

Still another object of this invention is to provide a lighting system, as aforesaid, which indicates the braking system of a skater.

A more particular object of this invention is to provide a lighting system, as aforesaid, which is easily rechargeable for subsequent use.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
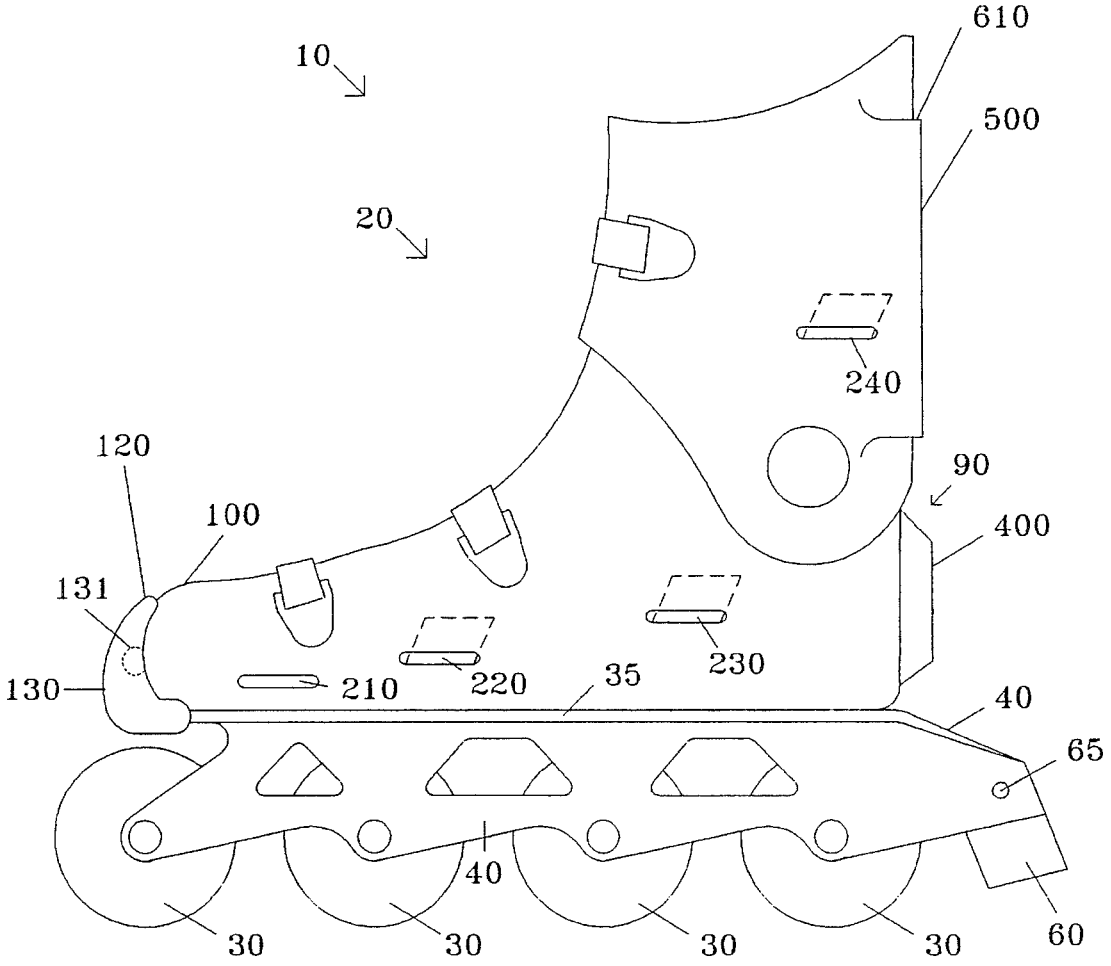
FIG. 1 is a side elevation view of a roller blade illustrating the presence of the headlight, side lights and brake lights thereon.
Figure 2:
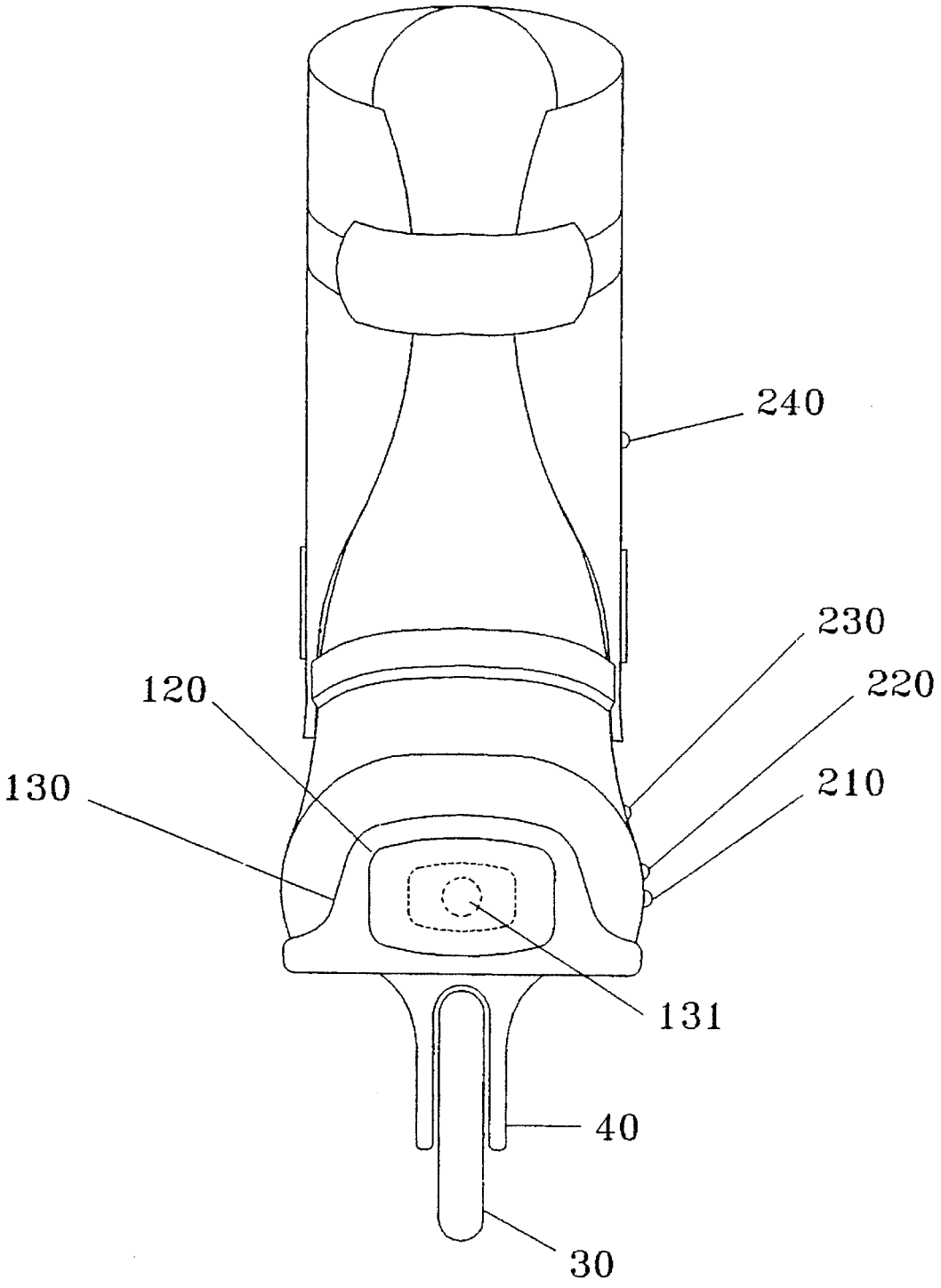
FIG. 2 is a front view of the roller blade of FIG. 1.
Figure 3:
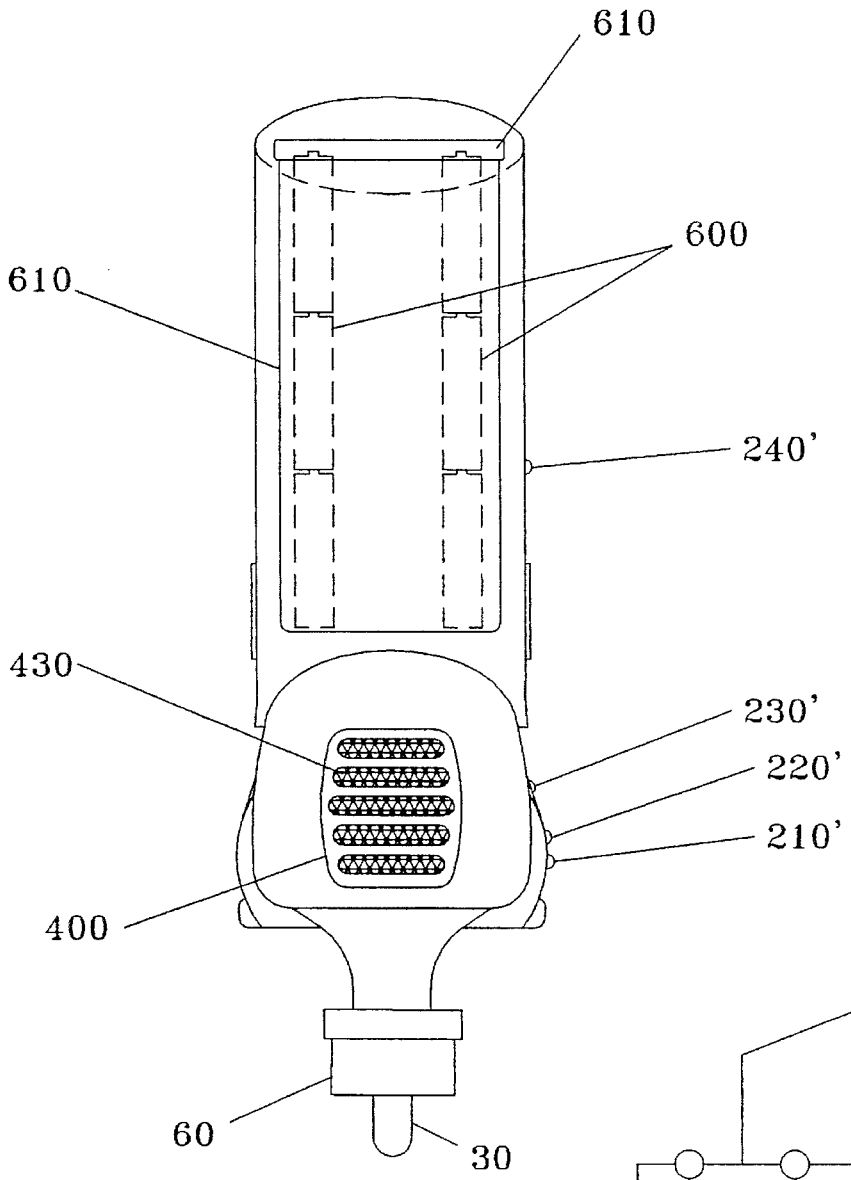
FIG. 3 is a rear view of the roller blade of FIG. 1.

Turning more particularly to the drawings, FIG. 1 illustrates a side view of a conventional, in-line roller blade 10. As shown, the blade 10 generally comprises a boot 20 having a plurality of rollers 30 mounted underneath the boot's sole 35 by means of a mounting bracket 40 extending along the sole 35. Positioned at the distal end of the mounting bracket 40 is a brake pad 60 rotatably mounted about pin 65 extending through bracket 40. Upon tilting of the skate 10 about the distal end the brake pad 60 contacts the skating surface so as to retard further forward roller 30 and user movement.

Positioned at the toe of the boot 20 is a headlight assembly 120 generally comprising a conventional bulb/reflector assembly mounted within a protective lens 130. The headlight 130 is attached to the toe 100 by gluing, sewing or in any other desirable manner. For example, grooves may be inserted into the boot during the manufacturing process such that the bulb 131 and/or lens 130 will snap into the appropriate groove. A cage-type structure may be substituted for lens 130 if so desired.

Extending along each side of the boot 10 is a plurality of lights 210, 220, 230 and 240 which can be of various configurations. The lights may snap into recesses formed in the boot during the manufacturing process so as to present a releasable male/female snap-fit relationship. Again, the lights may be alternatively attached to the boot in any conventional manner such as by gluing, sewing or the like.

Positioned at the heel 90 of the boot 10 is a brake light 400 assembly. Again, this light 400 may be of various configurations and mounted to the heel 90 by the above-described snap-fit relationship or by gluing, sewing or other fastening means. Extending along the back of the boot is a pocket for a power source 500 generally comprising a housing 610 having a plurality of releasable batteries 600 therein. A battery pack may be inserted within housing 610 instead of the plurality of batteries 600.

Figure 5:
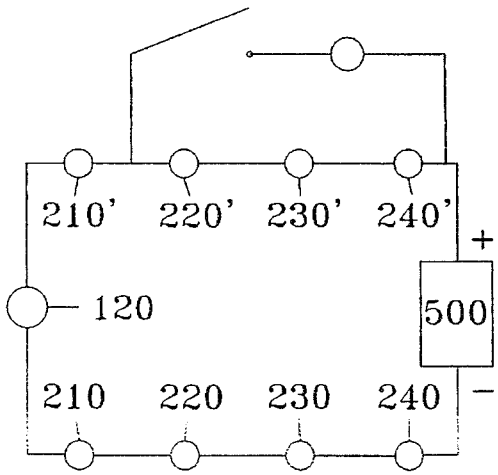
FIG. 5 is one form of an electrical schematic diagram for the lighting system as described herein.
Figure 4:
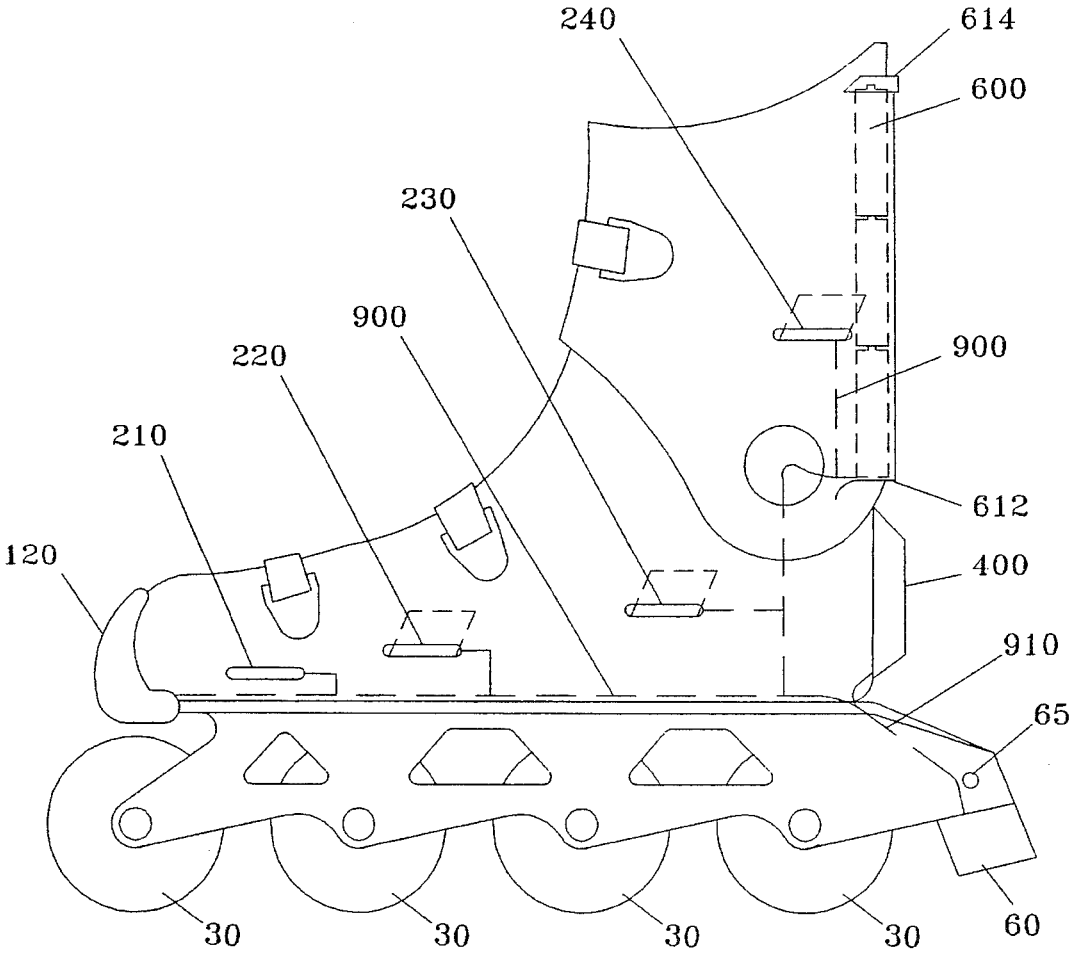
FIG. 4 is a side view of the roller blade similar to that of FIG. 1 but showing in phantom lines the electrical wiring of the lighting system.

A schematic wiring diagram is as shown in FIG. 5 with wires indicated in phantom lines in FIG. 4. The wire 900 extends from the positive and negative sides or poles 612, 614 of the power source, e.g., as the battery pack. The wire 900 forms a first circuit with the various side lights 210, 220, 230 and 240 and front headlight assembly 120 interposed therein. The wire 900 forms a circuit for current from the power source 500. As such, upon placement of the batteries 600 or battery pack within housing 610 current energizes these side lights. The wires 900 are shown in phantom in FIG. 4 and may be molded into the boot 10 during the molding process, it being understood that the wire 900 circuit will be interrupted by the various lights insertable within the boot 10.

Also, as shown in the wiring diagram, a second wire 910 extends from the power source in battery housing 610 so as to form a second circuit with the brake light assembly 400 interposed therein. This circuit is in a normally open position with the rotatable brake pad 60 serving as a switch for a user-selectable closing of the circuit. Accordingly, upon user-selectable contact of the brake pad 60 with the skating surface the second circuit will be closed causing a current flow to the brake light 400. The energized brake light will indicate to companion skaters that the skater is slowing/stopping. As such the brake pad 60 may be provided with a conventional type analog switch, e.g., a metal strip, so as to bridge wire ends 910 and close the circuit upon brake operation. Alternatively, a sensor-type switch may be used which will close the normally open circuit upon sensing a pressure thereon as provided by user contact of the brake pad 60 with the skating surface. The above-described circuit 910 again may be embedded in the skate boot 10 during the manufacturing process.

As such it is understand that my invention is not to be directed to the manner of attachment of the brake lights, batteries and/or switch means associated with the brake pad except as set forth in the following claims and allowable functional equivalents thereof.

Although one form of this invention has been illustrated and described, it is not to be limited thereto except as set forth in the following claims and allowable functional equivalents thereof.

Having thus described the invention, what is claimed as new and desired to be secured by Letters Patent is as follows:

1. For use with a roller blade or the like, a lighting system comprising:

a plurality of lights extending along a boot of the roller blade with at least one of said lights being positioned at a heel of the boot;

a power source in the boot;

a first circuit associated with said power source for energizing said at least one light positioned at the heel of the boot, said first circuit including a normally open switch means for precluding a current flow from said power source to said heel light during a rolling movement of the roller blade;

a brake pad;

means for mounting said brake pad to the roller blade boot and at a position spaced from a skating surface during rolling movement of the roller blade;

said switch means closing said first circuit only in response to said mounted brake pad contacting the skating surface whereby to provide a current flow to said heel light;

a second circuit associated with said power source for energizing said remaining plurality of lights.

2. The device as claimed in claim 1 wherein said switch means comprises sensor means responsive to said brake pad contact of said skating surface.

3. The device as claimed in claim 1 further comprising:

a headlight as one of said plurality of lights;

means for attaching said headlight to a toe of the boot and in said second circuit, said headlight illuminating a path of the roller blade user.

4. The device as claimed in claim 3 further comprising meals for covering said headlight.

5. The device as claimed in claim 4 wherein said cover means is a lens.

6. The device as claimed in claim 4 wherein said cover means is a protective cage.

7. For use with a roller blade or the like, a lighting system comprising:

a light positioned at a heel of a boot of the roller blade;

a power source in said boot;

a first circuit for connecting said power source to said heel light, said first circuit normally presenting an open switch for precluding a current flow from said source to said heel light;

a brake pad associated with the heel of the boot, said brake pad associated with said switch interposed in said first circuit in a manner for closing said switch only upon contact of said pad with a skating surface, said closed switch providing a current flow from said source to said heel lights.

8. The device as claimed in claim 7 wherein said closing means comprises:

a brake pad associated with the heel of the roller blade for a user-selectable contact with a skating surface, said brake pad including switch means interposed in said first circuit for closing said normally open circuit upon contact with the skating surface, said energized heel light indicating operation of said brake pad.

9. The device as claimed in claim 7 wherein said switch means comprises sensor means responsive to pressure thereon for closing said circuit.

10. The device as claimed in claim 7 further comprising:

a headlight assembly;

means for attaching said headlight to a toe of the boot and in said first circuit in a manner to provide a current flow from said power source to said headlight.

* * * * *

UNITED STATES PATENT AND TRADEMARK OFFICE

CERTIFICATE OF CORRECTION

PATENT NO. : 5,484,164

DATED : January 16, 1996

INVENTOR(S) : JAMES M. MCINERNEY and MITCH E. NORMAN

It is certified that error appears in the above-indentified patent and that said Letters Patent is hereby corrected as shown below:

Column 4, line 29, delete "lights" and substitute --light--.

Column 4, lines 30-37, delete claim 8.

Signed and Sealed this

Second Day of July, 1996

*Attest:*

*Attesting Officer*

BRUCE LEHMAN

*Commissioner of Patents and Trademarks*